US005503582A

United States Patent [19]

Cathey, Jr. et al.

[11] Patent Number: 5,503,582

[45] Date of Patent: Apr. 2, 1996

[54] METHOD FOR FORMING SPACERS FOR DISPLAY DEVICES EMPLOYING REDUCED PRESSURES

[75] Inventors: David A. Cathey, Jr.; Jim J. Browing, both of Boise, Id.

[73] Assignee: Micron Display Technology, Inc., Boise, Id.

[21] Appl. No.: 342,329

[22] Filed: Nov. 18, 1994

[51] Int. Cl.[6] ..... H01J 9/00

[52] U.S. Cl. ..... 445/24

[58] Field of Search ..... 445/24, 25

[56] References Cited

U.S. PATENT DOCUMENTS

| | | | |
|---|---|---|---|
| 2,933,648 | 4/1960 | Bentley | 445/25 X |
| 4,091,305 | 5/1978 | Poley et al. | 313/220 |
| 4,183,125 | 1/1980 | Meyer et al. | 29/25 |
| 4,293,376 | 10/1981 | Weingand | 445/24 X |
| 4,402,927 | 9/1983 | von Dardel et al. | 423/335 |
| 4,407,934 | 10/1983 | Kuchinsky et al. | 445/24 X |
| 4,422,731 | 12/1983 | Drogmet et al. | 350/344 |
| 4,451,759 | 5/1984 | Heynisch | 313/495 |
| 4,610,863 | 9/1986 | Tewari et al. | 423/338 |
| 4,667,417 | 5/1987 | Graser et al. | 34/9 |
| 4,923,421 | 5/1990 | Brodie et al. | 445/24 |
| 5,011,391 | 4/1991 | Kawasaki et al. | 445/24 |
| 5,151,061 | 9/1992 | Sandhu | 445/24 |
| 5,156,895 | 10/1992 | Martin | 428/72 |
| 5,186,670 | 2/1993 | Doan et al. | 445/24 |
| 5,199,917 | 4/1993 | MacDonald et al. | 445/24 |
| 5,205,770 | 4/1993 | Lowrey et al. | 445/24 |
| 5,210,472 | 5/1993 | Casper et al. | 315/349 |
| 5,229,331 | 7/1993 | Doan et al. | 437/228 |
| 5,232,549 | 8/1993 | Cathey et al. | 445/24 X |
| 5,259,799 | 11/1993 | Doan et al. | 445/24 |
| 5,270,027 | 12/1993 | Balducci et al. | 423/338 |

OTHER PUBLICATIONS

Klein, Lisa C., "Sol–Gel Process", Engineered Materials Handbook, Ceramics and Glasses, vol. 4, The Materials Information Society, 1991, pp. 209–213.

Borrelli, N. F. et al., "Photosensitive Glasses and Glass–Ceramics", Engineered Materials Handbook, vol. 4, The Materials Information Society, 1991. Pp. 439–444.

Stookey, S. D., "Photosensitive Glass", Industrial and Engineering Chemistry, vol. 41, No. 4, 1949.

FOTOFORM: A Material and a Capability, Corning advertising brochure, date unknown.

*Primary Examiner*—Kenneth J. Ramsey

*Attorney, Agent, or Firm*—Stephen A. Gratton

[57] ABSTRACT

A method for forming interelectrode spacers for flat panel display devices that employ reduced pressures, includes the steps of; forming a substrate out of an aerogel, xerogel photosensitive material (e.g., photosensitive glass, photosensitive aerogel, photosensitive xerogel); forming a pattern of openings and gas removal channels in the substrate; and then placing the substrate between a display screen and base plate of the display device. The substrate is formulated to be light weight, insulative and with a high compressive strength for resisting atmospheric loads placed on the display screen by the reduced pressure. In addition, the substrate is formulated to be easily etched, laser ablated or photochemically machined and assembled as a third member spacer structure.

22 Claims, 3 Drawing Sheets

METHOD FOR FORMING SPACERS FOR DISPLAY DEVICES EMPLOYING REDUCED PRESSURES

This invention was made with Government support under contract No. DABT63-93-C-0025 awarded by Advanced Research Projects Agency (ARPA). The Government has certain rights in this invention.

FIELD OF THE INVENTION

This invention relates to display devices employing reduced pressures, such as field emission displays, plasma displays and flat panel cathode ray tubes. More particularly, this invention relates to improved methods for forming interelectrode spacers for display devices without impairing image resolution.

BACKGROUND OF THE INVENTION

Flat panel displays have recently been developed for visually displaying information generated by computers and other electronic devices. Typically, these displays are lighter and utilize less power than conventional cathode ray tube displays. One type of flat panel display is known as a cold cathode field emission display (FED).

A cold cathode FED uses electron emissions to illuminate a cathodoluminescent display screen and generate a visual image. An individual field emission pixel typically includes one or more emitter sites formed on a baseplate. The baseplate contains the electrical devices that control the operation of the emitter sites. A gate electrode, or grid, is typically associated with the emitter sites. The gate electrode and baseplate are in electrical communication with a voltage source. When a sufficient voltage differential is established between the emitter sites and the gate electrode, a Fowler-Nordheim electron emission is initiated from the emitter sites. Electrons strike a phosphor coating on the display screen which releases photons to form a visual image.

In a large area FED, an arrangement of interelectrode spacers is used as an insulator to separate the baseplate and display screen and preserve the voltage differential. The spacers also function to support the display screen and maintain a small but uniform spacing between the display screen and emitter sites. This spacing needs to be small to achieve a high image resolution. Additionally, the spacing needs to be uniform to prevent image distortion and to provide a uniform resolution and brightness.

One problem with this type of display structure is that a uniform spacing may be difficult to achieve and maintain, especially for large area display screens. This problem is compounded because the area between the display screen and baseplate of a flat panel display is typically evacuated to a pressure of $10^{-6}$ Torr or less. The reduced atmospheric pressure is required to prevent the breakdown of the image and to allow electron emission. Under Paschen's law the breakdown voltage is a function of the product of the gas pressure and the spacing. The reduced atmosphere, however, places a tremendous atmospheric load on the display screen. The spacers and baseplate must resist this load and prevent the display screen from bending and warping under the pressure.

Recently, different processes have been developed in the art for forming spacers for FEDs and other flat panel displays. As an example, U.S. Pat. No. 5,232,549 entitled "Spacers For Field Emission Display Fabricated Via Self-Aligned High Energy Ablation" and U.S. Pat. No. 5,205,770 entitled "A Method To Form High Aspect Ratio Supports (Spacers) For Field Emission Display Using Micro-Saw Technology" disclose representative processes. Another process is disclosed in U.S. Pat. No. 4,923,421 entitled "Method For Providing Polyimide Spacers In A Field Emission Panel Display".

In the past, the preferred materials for the spacers have been silicon dioxide, polyimide, or a variation of polyimide, such as kapton and silicon nitride. Interelectrode spacers must be formed of a material that is electrically insulating yet strong enough to support the display screen from distortion. In addition, interelectrode spacers must be formed of a material that is stable under the electron bombardment generated in the display device and also capable of withstanding the high temperatures encountered during the manufacturing process. Typically, manufacturing temperatures may be on the order of 400° C. or more.

A further requirement is that the spacers be easily manufactured and assembled in a size and shape that does not interfere with the operation of the display device. One manufacturing problem is that some prior art spacer materials are relatively dense and cannot be easily etched. Silicon dioxide, for example, cannot be effectively used for thick spacers because of the difficulty and expense involved in patterning thick high-aspect ratio structures out of silicon dioxide.

OBJECT OF THE INVENTION

The present invention is directed to improved spacers and improved methods for fabricating spacers. Accordingly, it is an object of the present invention to provide an improved method for forming spacers and an improved spacer structure for display devices and other electronic equipment.

It is yet another object of the present invention to provide an improved method for forming spacers out of aerogel, xerogel and photosensitive materials.

It is a further object of the present invention to provide an improved method for forming interelectrode spacers for display devices using materials that are light weight, electrically insulating, stable at high temperatures, able to resist high compressive loads without deformation and easily fabricated using dry etch, laser ablation or photochemical machining processes.

Other objects, advantages and capabilities of the present invention will become more apparent as the description proceeds.

SUMMARY OF THE INVENTION

In accordance with the present invention an improved method of fabricating spacers, and an improved spacer structure, are provided. The method of the invention is suitable for forming interelectrode spacers for flat panel display devices such as field emission displays (FEDs), plasma displays or flat cathode ray tube displays, as well as other electronic devices that employ a reduced pressure. Each spacer is fabricated as a third member substrate that is formed in a separate manufacturing operation and then placed between electrode plates of the display device during its assembly. The third member substrate is formed of an aerogel, xerogel, or photosensitive materials.

Aerogels and xerogels, broadly stated, are solid materials having a gas dispersed therein. These material are prepared using sol-gel processing techniques followed by a drying step in which the solvent used in the process is extracted to leave a low density structure. For aerogels the drying step is performed at a temperature and pressure that are above the solvent critical point in order to by-pass the liquid-vapor interface of the solvent. The vapor is then vented leaving a network of about 95% porosity. During subsequent processing, this network is de-aired and the pores are closed by heat treatment.

Xerogels are similar to aerogels but are dried by natural evaporation of the solvent and water to the atmosphere. While the liquid is evaporating, the gel structure is collapsing on itself. In general, xerogels are denser than aerogels, have smaller pores and are simpler to manufacture. Both aerogels and xerogels can be formed into sheets having predetermined dimensional and geometrical characteristics which can be easily etched to provide an improved spacer structure. This improved structure includes precisely dimensioned openings and gas removal channels.

Photosensitive materials are sensitive to light or other electromagnetic radiation. Photosensitive materials include photosensitive glasses, photosensitive aerogels and photosensitive xerogels. Exposure to radiation produces a change in the characteristics of these materials. Photosensitive materials can be formulated to be photochemically machinable. This is accomplished by exposing the material to radiation and then etching. An improved spacer structure can also be fabricated using a photochemical machining process.

Other objects, advantages and capabilities of the present invention will become more apparent as the description proceeds.

DETAILED DESCRIPTION OF THE PREFERRED EMBODIMENTS

Initially a substrate is formed of an aerogel, xerogel or photosensitive material (e.g., photosensitive glass, photosensitive aerogel, photosensitive xerogel). A substrate comprising an aerogel or xerogel material can be formed as a sheet and then patterned and etched using dry etching or laser ablation processes. This is shown in FIGS. 1–4. A substrate comprising a photosensitive material can be patterned and etched using a photochemical machining process. This is shown in FIGS. 5A–5D. FIG. 6 shows a substrate constructed in accordance with the invention assembled as used as a spacer in an assembled FED.

Figure 1:
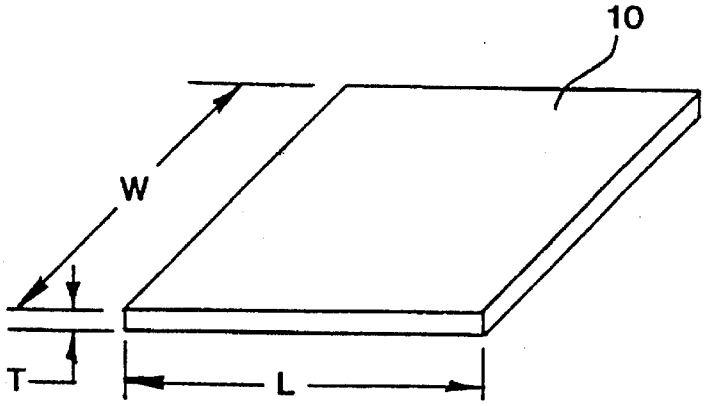
FIG. 1 is a perspective view of a substrate formed to a predetermined thickness out of an aerogel or xerogel material.

With reference to FIG. 1, a substrate 10 is formed of a sheet of aerogel or xerogel material having a predetermined thickness of "T". By way of example, the thickness "T" may be on the order of 10 μm to 1000 μm. In addition, the substrate 10 is formed with a polygonal peripheral configuration having predetermined length "L" and width "W" dimensions. These dimensions will be on the order of inches to feet.

Different methods of formulating aerogels and xerogels are known in the art. As an example, U.S. Pat. Nos. 4,610,863; 4,667,417; and 5,221,364 describe representative processes. In general, aerogels and xerogels can be tailored to have densities between about 50% of bulk glass to only a few times the density of air. The Young's Modulus ranges for aerogels and xerogels range from 1 to 600 MPa for densities from 3% to 20% of bulk glass.

The first step in forming an aerogel or xerogel is the formulation of a sol or solution. The solution can be one component or multicomponent. For a silica based system there are many silicon alkoxides that are readily hydrolyzed and go through a sol-gel transition. One well known technique for forming silica based aerogels and xerogels involves the hydrolysis and condensation polymerization of tetraethylorthosilicate (TEOS). This technique is described in detail in *Engineered Materials Handbook,* published by The Materials Information Society, volume 4, in the article entitled "Sol-Gel Process" by Lisa C. Klein.

TEOS is the product of the reaction of $SiCl_4$ or Si with ethanol. Because TEOS is insoluble in water, to initiate the hydrolysis reaction, TEOS and water must be combined in a mutual solvent such as ethanol. A typical formulation may be 43 vol % TEOS, 43 vol % ethanol, and 14 vol % water. This formulation is mixed at a constant temperature to initiate the hydrolyzation and polymerization reaction. Various intermediate species are formed as the reaction continues. At a certain point the viscous solution will become an elastic gel.

The gel comprises an oxide skeleton and a solvent phase in the pores. The solvent phase must be removed by drying. Depending on how the solvent is formed either an aerogel or xerogel is formed. With an aerogel the temperature and pressure are above the critical point of the solvent such that the liquid-vapor interface is by passed. The vapor can then be vented leaving a low density silicon glass network that is about 95% porous. The porous network is then de-aired and the structure is hardened by heat treatment. In aerogels the pore size is on the order of about 10 to 50 nm (100 to 500 Å).

With a xerogel the solvent is removed by natural evaporation. As the liquid solvent evaporates the gel structure collapses. Xerogels are denser than aerogels and have a pore size on the order of 2 to 5 nm (20 to 50 Å).

A flat aerogel or xerogel substrate 10 can be formed with a desired dimensioning and geometrical configuration using a suitable mold. Following formation of the substrate 10, a photopatterning and dry etch process can be used to pattern openings 16 and channels 18 in the substrate 10. This is shown in FIGS. 2–4.

Figure 2:
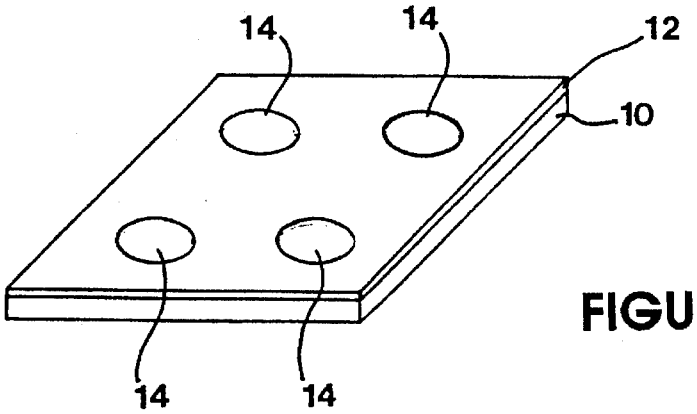
FIG. 2 is a perspective view of the substrate and an etch mask formed on the substrate for patterning and etching.

With reference to FIG. 2, following the formation of the substrate 10 to a predetermined thickness and geometrical configuration, an etch mask 12 is formed on the substrate 10. The etch mask 12 may be photoresist patterned by passing ultraviolet light, or another form of radiant energy, through a reticle containing the desired pattern. The photoresist is then developed for removing either the exposed portions of resist for a positive resist or the unexposed portion for a negative resist to form a pattern of openings 14.

Figure 3:
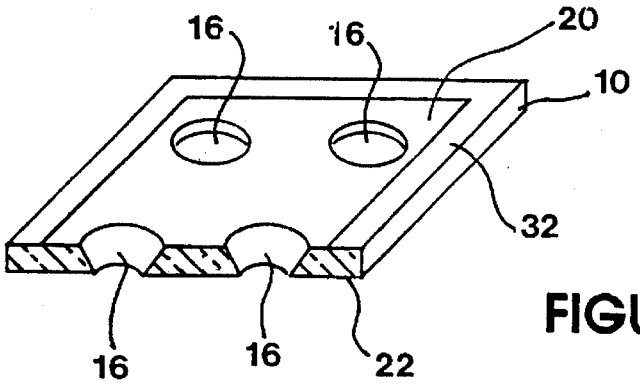
FIG. 3 is a perspective view, partially cut away and cross sectioned of the substrate etched with a predetermined pattern of openings.
Figure 4:
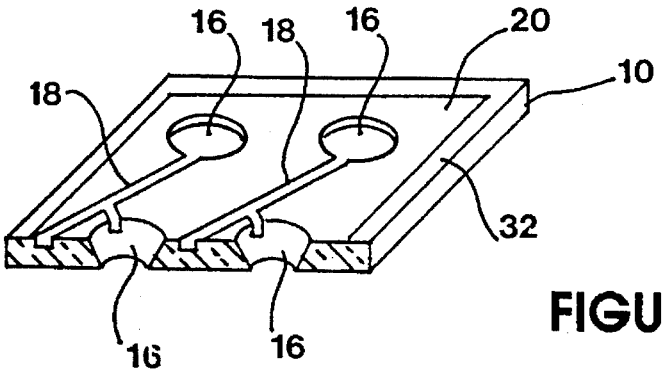
FIG. 4 is a perspective view, partially cut away and cross sectioned of the substrate etched with a pattern of channels to the openings.

Next, as shown in FIG. 3, the etch mask 12 is used to etch openings 16 through the substrate 10. The substrate 10 may be etched using a dry etch process such as reactive ion etching (RIE) or plasma etching. In such a dry etch process, the etch rate is determined by the power supplied to the electrodes, the chemistry of the gas etchants and the vacuum pressure in the process chamber. Etch rates for aerogels and xerogels are relatively high in comparison to a conventional spacer material such as silicon dioxide. Furthermore, high aspect ratio features (i.e., high ratio of length to diameter) can be formed with such easily etchable material. Suitable gas etchants for etching aerogels and xerogels include oxygen ($O_2$) and fluorine species such as $CF_4$, $SF_4$, and $SF_6$. Following the etch process, the etch mask 12 is stripped. This may be done by stripping the etch mask 12 with suitable wet chemicals such as a solution of sulfuric acid or hydrogen peroxide.

The openings 16 formed in the substrate 10 have a generally conical shape with a diameter that decreases from a top surface 20 to a bottom surface 22 of the substrate 10. In the assembled FED 34 shown in FIG. 6, the openings 16 allow electrons emitted from emitter sites 40 of the FED 34 to pass through the substrate 10 to a display screen 48. In a plasma display device the openings 16 would provide a space for generation of a plasma.

Still referring to FIG. 3, the substrate 10 also includes borders 32 along the periphery of the substrate 10. The borders 32 are relatively thicker than the remainder of the substrate 10 and can be formed by an etch process similar to the above described process for forming the openings 16. The borders 32 provide a framework or support structure.

Next, as shown in FIG. 4, channels 18 are formed in a top surface 20 of the substrate 10. The channels 18 interconnect the openings 16 with one another and to the borders 32 (FIG. 3) of the substrate 10. The channels 18 provide a conduit for gas removal during evacuation of the assembled FED 34 (FIG. 6). The channels 18 may be formed by a photopatterning and etch process similar to the process previously described for etching the openings 16 in the substrate 10. During this etch process an etch mask (not shown) is formed that defines the edges of the channels 18. Using this etch mask the channels 18 are then etched to a predetermined depth with a dry etch process such as RIE or plasma etching.

In place of a dry etch process for forming the openings 16 and channels 18 in the substrate 10, a laser ablation process may be used. The laser ablation process can be similar to the dry etch process previously described in that an etch mask carrying the desired pattern is formed on the substrate 10. A laser is then directed at the substrate 10 to ablate excess substrate material to form the openings 16 and channels 18. The laser can also be preprogrammed to scribe excess material thus eliminating the patterning step. Previously cited U.S. Pat. No. 5,232,549 describes a laser ablation process for forming spacers for a display device.

FIGS. 5A–5D illustrate the formation of a substrate 10' out of a photosensitive material. This photosensitive material can be a photosensitive glass, a photosensitive aerogel or a photosensitive xerogel. By way of example, photosensitive glass materials are described in the article by S. D. Stookey entitled "Photosensitive Glass" *Industrial and Engineering Chemistry,* Vol. 41, N. 4 (April 1949). Other formulations for photosensitive glass are described in *Engineered Materials Handbook,* published by The Materials Information Society, Volume 4, in the article entitled "Photosensitive Glasses and Glass-Ceramics" by N. F. Borrelli and T. P. Seward.

Figure 5A:
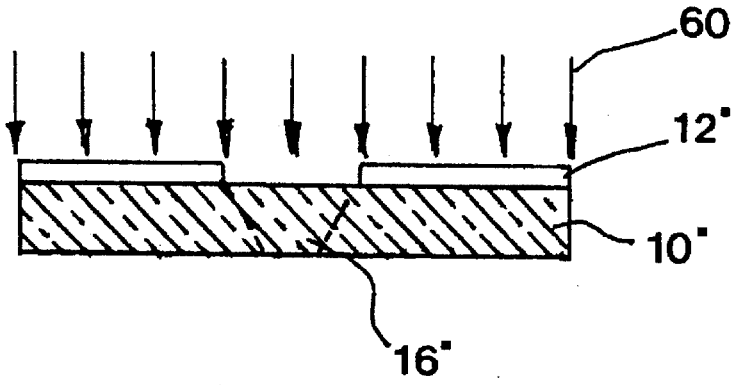
FIGS. 5A–5D illustrate the steps involved in forming spacers in accordance with the invention utilizing a photosensitive glass substrate or photosensitive aerogel and xerogel.
Figure 6:
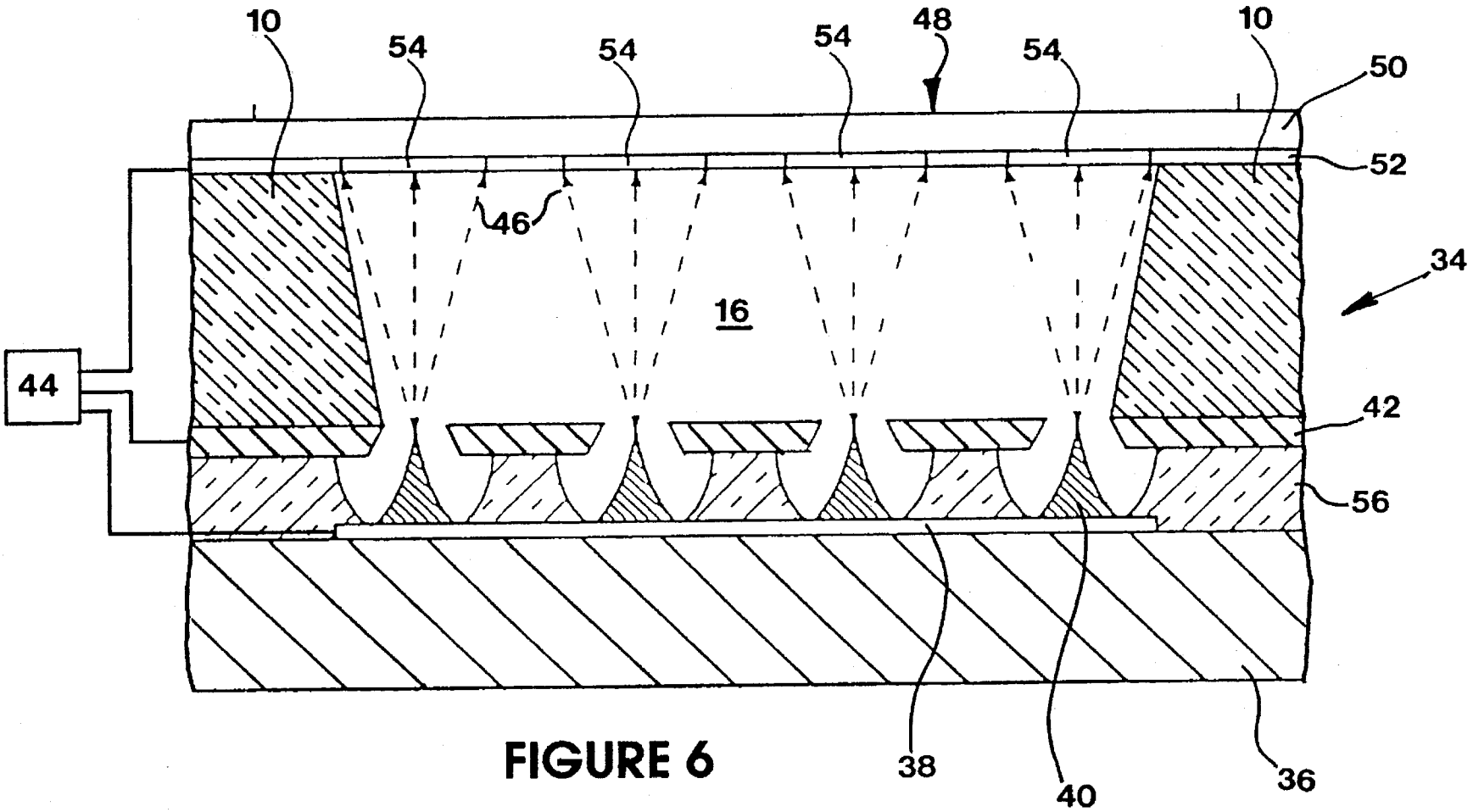
FIG. 6 is a schematic cross sectional view of an FED assembled with spacers formed in accordance with the invention.

As shown in FIG. 5A, a mask 12' is placed on the substrate 10'. The substrate 10' is formed of the photosensitive material. Exposure to a source of radiation, such as collimated light 60, forms a latent image 16' of the opening 16' previously described.

Figure 5B:
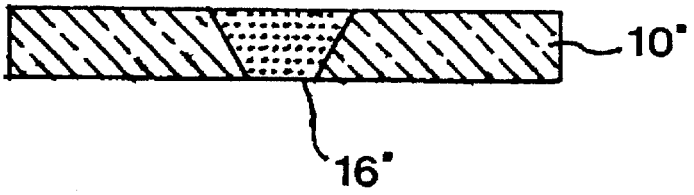

Next, as shown in FIG. 5B the mask 12' is removed and the latent image 16' is developed using heat treatment. During this process the substrate 10' is heated to a temperature in the range of 500° to 600° C.

Figure 5C:
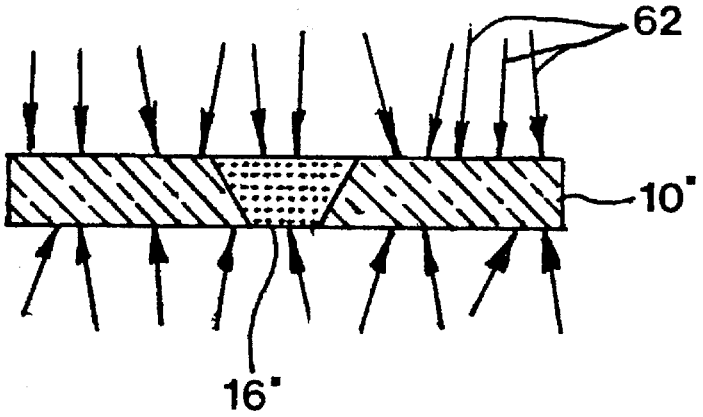

Next, as shown in FIG. 5C the substrate 10' is flooded with uncollimated UV light 62. No mask is required for this process which exposes the clear areas of the substrate 10'.

Figure 5D:
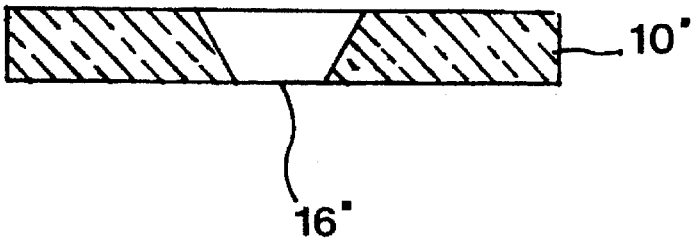

Next, as shown in FIG. 5D, the substrate 10' is etched to form the opening 16". Depending on the substrate material, etching may be accomplished using a wet etchant such as dilute HF acid. Following etching, the substrate 10' can be further processed as required. As an example, photosensitive glass material can be heated to a temperature of about 850° C. to convert the glass material to a ceramic.

In addition, grooves similar to grooves 18 (FIG. 4) can also be formed in the same manner as the openings 16" by controlling the depth of the etch. Furthermore, borders similar to borders 32 (FIG. 4) can be formed by etching a rectangular area in the substrate 10' to a required depth.

Referring now to FIG. 6, following formation of the substrate 10 (or 10'), the FED 34 is assembled with the substrate 10 functioning as an interelectrode spacer. The assembled FED 34 includes a baseplate 36 formed with a conductive layer 38. An array of electron-emitting emitter sites 40 are formed on the conductive layer 38.

A gate electrode structure, or grid 42, is associated with the emitter sites 40. The grid 42 and baseplate 36 are connected to an electrical source 44 which establishes a voltage differential for initiating a Fowler-Nordheim electron emission from the emitter sites 40. The grid 42 is separated from the substrate 36 by an insulating layer 56. The insulating layer 56 provides support for the grid 42 and prevents the breakdown of the voltage differential applied by the source 44. Electrons 46 emitted by the emitter sites 40 impinge on a cathodoluminescent display screen 48. The display screen 48 includes an external glass face 50, a transparent electrode 52 and phosphors 54.

In the assembled FED 34, the substrate 10 is placed as a third member spacer placed between the baseplate 36 and the display screen 48. Following the assembly of the FED 34, the substrate 10 functions as an interelectrode support structure and an electrode plate insulator. During the assembly process, the openings 16 in the substrate 10 are precisely aligned with the emitter sites 40. This allows a free flow of electrons from the emitter sites 40 to the display screen 48.

Following the assembly of the FED 34, the interior of the FED 34 is evacuated to a pressure of $10^{-6}$ Torr or less using an evacuation pump or similar apparatus. Typically, during the evacuation process the FED 34 is heated to a temperature of around 400° C. to create a high vacuum between the baseplate 36 and the display screen 48 of the FED 34. During the evacuation process the channels 18 (FIG. 4) formed in the substrate 10, provide a conduit for gas removal from the openings 16 and from the interior of the FED 34. These channels 18 terminate at the borders 32 (FIG. 3) of the substrate 10 and can thus be placed in direct flow communication with the evacuation pump.

The substrate 10 supports the display screen 48 and provides the structural rigidity necessary for resisting the atmospheric loads placed on the display screen 48 by the vacuum atmosphere. For some applications, the insulative properties of the substrate 10 prevent the breakdown of the voltage differential between the display screen 48 and baseplate 58 of the FED 34. For some applications, a highly resistive coating or spacer material may be deposited or placed on a surface of the spacer in order to prevent charge build-up and racing.

Thus the method of the invention provides an improved method for forming spacers and an improved spacer structure. Although the method of the invention has been described in an illustrative embodiment for forming interelectrode spacers for a FED, it is to be understood that the method of the invention can be used for forming interelectrode spacers for other display devices such as plasma displays and flat cathode ray tubes. As will be apparent to those skilled in the art, certain changes and modifications can be make without departing from the scope of the invention as defined by the following claims.

What is claimed is:

1. A method for forming an interelectrode support structure for a display device comprising:

forming a substrate out of a material selected from the group of materials consisting of aerogels and xerogels;

forming a pattern of openings in the substrate;

aligning and assembling the substrate between a first electrode and a second electrode of the display device; and forming a reduced atmosphere between the first and second electrodes.

2. The method as recited in claim 1 and further comprising forming a predetermined pattern of gas removal channels in the substrate extending from the openings to a border of the substrate.

3. The method as recited in claim 1 and wherein the openings are formed using a dry etch process.

4. The method as recited in claim 1 and wherein the openings are formed using a laser ablation process.

5. The method as recited in claim 1 and wherein the substrate is formed of a material selected from the group consisting of photosensitive aerogels and photosensitive xeroxels and the openings are formed using a photochemical machining process.

6. The method as recited in claim 1 and wherein the display device is a field emission display.

7. The method as recited in claim 1 and wherein the display device is a plasma display.

8. The method as recited in claim 1 and wherein the display device is a flat cathode ray tube.

9. A method for forming spacers for a field emission display comprising:

forming a substrate in a predetermined geometrical shape out of a material selected from the group of materials consisting of aerogels, and xerogels;

forming a border along an edge of the substrate;

forming a predetermined pattern of openings through the substrate;

forming a predetermined pattern of gas removal channels in the substrate extending from the openings to the border of the substrate; and aligning and assembling the substrate between a base plate and a display screen of the field emission display.

10. The method as recited in claim 9 and wherein the openings are formed with a generally conical shape.

11. The method as recited in claim 9 and wherein the openings and channels are formed using a dry etch process.

12. The method as recited in claim 9 and wherein the openings and channels are formed using a laser ablation process.

13. The method as recited in claim 9 and wherein the substrate is a third member that is fabricated separately and then assembled in the field emissions display.

14. A method of forming spacers for a field emission display comprising:

forming a substrate out of a material selected from the group of materials consisting of aerogels and xerogels;

forming an etch mask on the substrate;

etching the substrate through the etch mask with a predetermined pattern of openings using a dry etch process;

etching a surface of the substrate with a predetermined pattern of gas removal channels extending between the openings and a border of the substrate;

aligning and assembling the etched substrate between a base plate and display screen of the field emission display; and evacuating an interior of the field emission display to form a reduced atmosphere therein.

15. The method as recited in claim 14 and wherein the substrate is an aerogel formed by a sol-gel process in which a solution is combined with water and a solvent to initiate hydrolyzation and polymerization followed by removal of the solvent by vaporizing at a pressure and temperature above a critical point.

16. The method as recited in claim 14 and wherein the substrate is a xerogel formed by a sol-gel process in which a solution is combined with water and a solvent to initiate hydrolyzation and polymerization followed by removal of the solvent by evaporation.

17. The method as recited in claim 14 and wherein the substrate is formed by a sol-gel process using a solution containing a silicon alkoxide.

18. The method as recited in claim 17 and wherein the silicon alkoxide is tetraethylorthosilicate.

19. The method as recited in claim 14 and wherein the etching process is reactive ion etching.

20. The method as recited in claim 14 and wherein the etching process is plasma etching.

21. A method of forming spacers for a field emission display comprising:

forming a substrate out of a material selected from the group consisting of photosensitive aerogels and photosensitive xeroxels;

forming a mask on the substrate;

etching the substrate through the mask with a predetermined pattern of openings using a photochemical machining process;

aligning and assembling the substrate between a base plate and display screen of the field emission display, and then evacuating an interior of the field emission display to form a reduced atmosphere therein.

22. The method as recited in claim 21 and further comprising photomachining the substrate with a predetermined pattern of gas removal channels extending from the openings to a border of the substrate.

* * * * *